United States Patent [19]

Karsten et al.

[11] 3,980,068

[45] Sept. 14, 1976

[54] GASOLINE POWERED MACHINE HAVING TWO ELECTRIC CIRCUIT SWITCHES

[75] Inventors: Lee L. Karsten, Racine; Merlin H. Gandrud, Sturtevant, both of Wis.

[73] Assignee: Jacobsen Manufacturing Company, Racine, Wis.

[22] Filed: Mar. 25, 1975

[21] Appl. No.: 561,772

[52] U.S. Cl. ..... 123/198 DC; 200/157; 56/DIG. 15

[51] Int. Cl.[2] ..... F02B 77/08

[58] Field of Search... 123/198 D, 198 DB, 198 DC, 123/179 SE; 56/DIG. 15; 180/96, 99; 200/61.85, 61.89, 61.9, 157

[56] References Cited

UNITED STATES PATENTS

| | | | |
|---|---|---|---|
| 3,417,470 | 12/1968 | Damon | 200/157 X |
| 3,695,379 | 10/1972 | Veilleux | 123/198 D X |
| 3,726,264 | 5/1975 | Lariviere | 123/198 DC X |
| 3,734,230 | 5/1973 | Tanaka | 123/198 DC X |
| 3,742,928 | 7/1973 | Albertson | 123/198 DC X |
| 3,758,736 | 9/1973 | Tanaka | 123/198 DC X |
| 3,789,938 | 2/1974 | Hetteen | 123/198 DB X |
| 3,798,402 | 3/1974 | Raab | 123/198 DC X |
| 3,849,620 | 11/1974 | Melisz | 123/198 DC X |
| 3,881,461 | 5/1973 | Filip | 123/198 DC X |

*Primary Examiner*—Charles J. Myhre
*Assistant Examiner*—Ira S. Lazarus
*Attorney, Agent, or Firm*—Arthur J. Hansmann

[57] ABSTRACT

A gasoline powered machine, shown in the form of a lawn mower, having a gasoline engine, and a mower deck for a housing, and a mower handle, and ground engaging wheels. The engine has the usual electric circuitry connected thereto, and two electric switches are connected with the circuitry for grounding the circuit and thereby stopping operation of the engine when the switches are not being operated, and that is when they are then in a normally-closed position. Therefore, the operator must be in physical contact with either of the two switches to maintain either one in an open position in order to have the gasoline engine operating.

3 Claims, 5 Drawing Figures

FIG. 2
FIG. 3
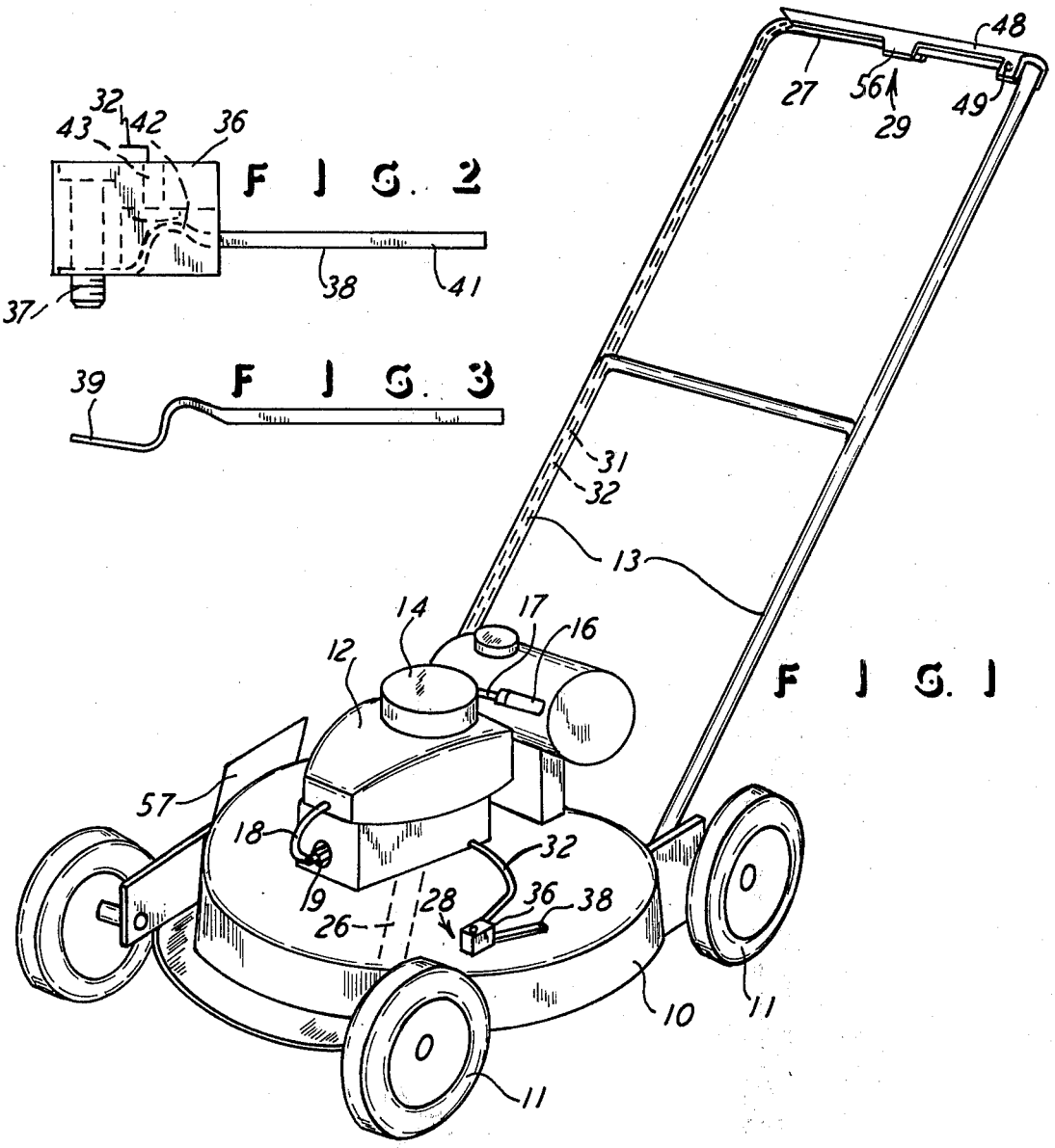
FIG. 1
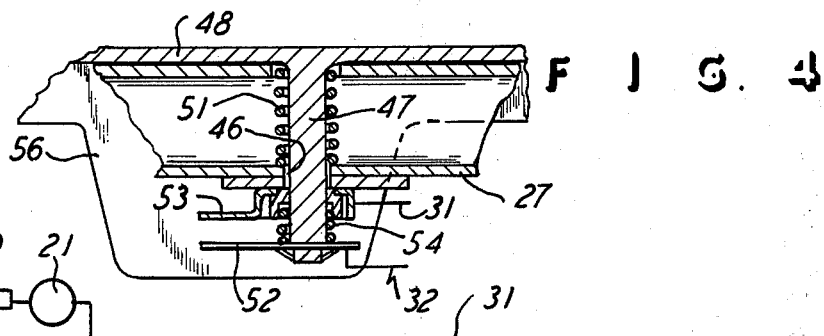
FIG. 4
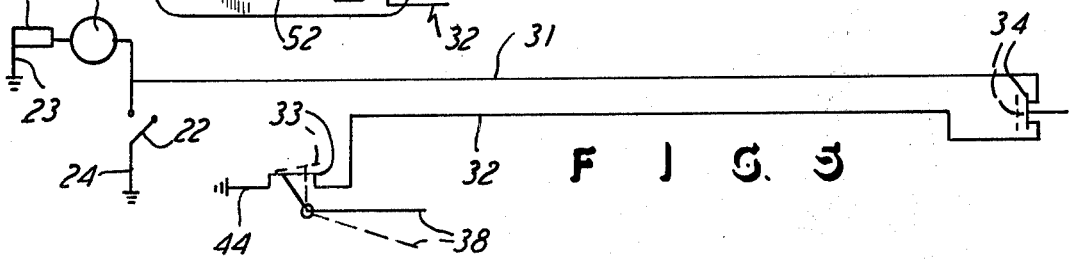
FIG. 5

GASOLINE POWERED MACHINE HAVING TWO ELECTRIC CIRCUIT SWITCHES

This invention relates to a gasoline powered machine, such as a lawn mower, and it includes prerequisite switches, in the form of safety electric switches, which must be maintained in a set position by the operator in order for the engine to be operating.

BACKGROUND OF THE INVENTION

Of course the prior art is replete with gasoline powered machines which have electric circuitry for creating the combustion of the gasoline within the engine, and these prior art machines include lawn mowers powered by gasoline engines and having electric circuitry and switches for operating and controlling the operation of the engine. Included in this prior art, are arrangements of lawn mowers with electric circuitry and electric switches which are commonly positioned on the lawn mower handle and are arranged to ground the electric circuitry to thereby preclude or stop the operation of the gasoline engine. As such, the prior art lawn mowers having these electric stop switches serve as convenient and safety switches which enable the operator to have safe and full control of the engine.

However, the prior art arrangements are such that the operator can either start the engine or have it continue to operate without requiring that he be in physical contact with or in control of the particular electric switch of the type mentioned above. That is, the switch can be set in the position to permit the engine to operate, and the operator can then remove himself from the switch, including releasing the hand-grasping of the switch, and he can then start the engine or run the engine without any requirement that he be holding the switch itself. To this extent, the prior art gasoline powered machines, including lawn mowers are not inherently safe since the machine can be started and can also be operated without the operator being in physical contact with the switch such as by holding the switch in a certain set position.

Accordingly, it is an object of this invention to overcome the aforementioned deficiencies and shortcomings of the prior art gasoline powered machines, such that, the gasoline powered machine of this invention requires that the operator be in physical contact with the electric switch which is controlling the running of the gasoline powered engine. As such, the present invention provides a safety feature, and it therefore precludes the possibility of the operator leaving the machine unattended while the gasoline engine is running. As such, the present invention provides a so-called dead man's type of control which requires that the operator be grasping the member or actuator which physically positions the switch, in order to have the engine in an operating condition.

Another advantage and object of this invention is to provide a gasoline powered machine with electric circuitry having two switches which require that the operator be in physical contact with one of the two switches to thereby be in a certain position relative to the machine, and such position is commonly a safe position away from the operating or moving parts of the machine or away from the cutter blades and the discharge outlets of a machine such as a lawn mower.

Other objects and advantages will become apparent upon reading the following description in light of the accompanying drawings.

BRIEF DESCRIPTION OF THE DRAWINGS

FIG. 1 is a front perspective view of a rotary lawn mower having a preferred embodiment of this invention.

FIG. 2 is a side elevational view of one of the switches shown in FIG. 1.

FIG. 3 is a side elevational view of the switch actuator shown in FIG. 2.

FIG. 4 is an enlarged sectional view through one of the switches shown in FIG. 1, and showing a fragment of the handle of FIG. 1.

FIG. 5 is an electric schematic view of the electric circuitry utilized in the mower in FIG. 1.

DETAILED DESCRIPTION OF THE PREFERRED EMBODIMENT

FIG. 1 shows a rotary-type lawn mower of a substantially conventional arrangement, except for the electric circuitry described hereinafter. Further, it will be understood that the rotary lawn mower is a gasoline powered machine, and the embodiment of this invention may also be incorporated in a reel type of lawn mower, a snow thrower, and similar and other powered machines and implements. Still further, the particular invention is especially concerned with and suitable for incorporation in machines which have moving parts which are a danger to the operator, such as mower cutting blades and snow thrower impellers and the like. Accordingly, the present invention requires that the operator be in a certain position relative to the machine, and, in that position, he must then be in physical contact with an electric switch in order to have the prime mover of the machine in an operating condition. In this instance of the gasoline powered machines, such as the lawn mower shown in FIG. 1, when the operator is not in contact with either one of two electric switches, then the switches are in a condition which electrically grounds the prime mover to thereby preclude the operation of the prime mover.

FIG. 1 shows the powered machine to be in the form of a rotary type of lawn mower of a conventional arrangement in that it has a housing member or deck 10 and the usual ground engaging wheels 11, and a gasoline powered engine 12 and a U-shaped handle 13. Further, the engine 12 has the usual starter mechanism 14 which may be of the rope pull type with the usual rope recoil and with the usual handle 16 for pulling on the starter rope 17 to thereby rotate the shaft of the engine 12 for starting the engine, all in the well-known construction and manner. Further, the machine has the usual electric circuitry, such as the ignition wire 18 and the spark plug 19, and it has the usual and conventional electric elements indicated in FIG. 5, including the magneto 21 and the usual electric stop switch 22, and it will be noticed that the spark plug 19 is shown schematically grounded at 23 and the switch 22 is shown grounded through the wire 24.

Therefore, except for the elements of this invention as hereinafter described, it will be understood by one skilled in the art that the powered machine is shown to be a rotary lawn mower having the prime mover of the gasoline engine for rotating the usual mower blade 26 which rotates within the housing or deck 10, and the operator would control and steer the mower by use of the handle 13, and particularly through the usual horizontally disposed and cross portion 27 of the handle 13. Further, except for the elements of this invention, the operator would start the gasoline engine 12 by pulling on the handle 16 to actuate the starter 14 and in turn commence operation of the engine 12.

This particular invention incorporates two electric switches in the electric circuitry described, and these two switches are generally shown at the location designated 28 and the location designated 29, respectively. The two switches are shown in FIG. 5 to be in electric series connection in the electric circuit shown in FIG. 5, and wires 31 and 32 thereby connect the switches which are now designated 33 and 34.

The drawings therefore show the switch 33 to be mounted on the machine housing or member 10, such as the mower deck 10, and it includes a housing block 36 and a mounting screw 37, as seen in FIG. 2, to attach the switch 33 to the machine housing. A switch actuator 38, in the form of a spring biased lever, is included in the switch 33, and FIG. 3 shows that the actuator 38 is spring biased and has its inner end 39 upturned when it is not in the sprung position such as the position it is in in FIG. 2. Therefore, the actuator has an extending lever end 41 which is available to be depressed by the operator's foot, and the actuator contact portion 42 can thus move away from an electric contact 43 in the switch housing 36 to thus open the electric connection between the wire 32 and a grounding portion 44 of the switch 33. That is, the actuator 38 extends from the switch housing 36 and is available to be depressed by the operator's foot when the operator is in a position standing adjacent the mower housing 10 and he is therefore in position to pull back on the starter handle 16 for the usual maneuvering of starting the engine 12. However, in this instance, the operator must be actuating the switch 33, and he does this by depressing the actuator 38 as described to thereby open the switch 33 which is a normally-closed switch as seen in the FIG. 2 position where the switch contact 43 may be grounded through the actuator portion 42 and 39 and to the mower deck 10. Of course without depressing the actuator 38, the switch 33 will be in its normally-closed position, as shown by the full lines in FIG. 5, and therefore the electric circuitry for the engine 12 will be grounded through the switch 33 and the engine will not be able to operate. Further, the dotted lines representing the switch 33 in FIG. 5 show the switch in a schematic open position which is the position when the operator is depressing the actuator 38 with his foot, as described. Accordingly, FIG. 5 only schematically shows the arrangement of a switch 33 which is a normally-closed switch, in the full line position of FIG. 5, and the switch is moved to the open and thereby ungrounded position when the operator depresses the actuator 38, and this is shown by the dotted lines in the schematic showing of FIG. 5. Of course, in actuality, the actuator 38 may be physically moved away from the electric contact 43 of the switch 33 when the operator is depressing the actuator 38, to thereby preclude and avoid the normally-closed position of the switch 33 and thereby have the switch in the open position and thus not grounded.

The switch 34 is also a normally-closed electric switch, and it is shown schematically in FIG. 5 to be in the closed position in full lines and to be in the open position in the dotted line showing. Here also, in order to have the switch 34 in the open position, the operator must be in physical contact with the switch 34, just as is required with respect to the switch 33, but the operator needs to have only one of the two switches 33 and 34 in the open position, in order to avoid grounding the engine's electric circuitry and to thereby permit operation of the engine. The switch 34 is shown in FIG. 4 to be mounted on the handle portion 27 which may be of the usual tubular handle construction for a lawn mower, and the portion 27 is shown to have an opening 46 which slidably receives a stem 47 attached to a switch actuator 48 which extends along the handle portion 27 and is pivoted thereon by means of a pin 49 extending through one of the actuator 48 and through the handle portion 27. A compression spring 51 bears against the handle portion 27 and against the actuator 48 to yieldingly urge the actuator in the pivoted position away from the handle portion 27 and upwardly, relative to the position shown in FIG. 4. Also, the stem 47 carries an electric contact member 52 and another electric contact member 53, and these members 52 and 53 are therefore shown in their spaced-apart positions which is the open switch position consistent with the operator depressing the actuator 48 and holding it in the position shown in FIG. 4. However, when the operator releases the actuator 48, such as by releasing his grip on the handle portion 27 and possibly walking away from the lawn mower, then the spring 51 will pivot the actuator 48 upwardly, as seen in FIG. 4, and thus cause the contacts 52 and 53 to come closer together to thereby close the switch 34 and thus ground the engine's electric circuit and thereby stop the operation of the engine. Further, the spring 51 will hold the switch in the normally-closed position, and another compression spring 54 is overcome by the force of the spring 51, and the spring 54 simply holds the contact 52 downwardly and away from the contact 53 but yet permits complete resilience or flexibility in making and breaking the contacts 52 and 53, as will be apparent to one skilled in the art. The actuator 48 has side extension portions 56 which flank the switch 34 and thus close it in and protect it and the operator from inadvertent contact.

With the two switches 33 and 34, the operator must be in physical contact with one of the switches in order for the electric circuit to be in the operative and ungrounded condition and to thereby have the engine 12 operating. Therefore, if the operator removes himself from contact with either of the switches, the engine will cease operating, and this is therefore a safety device. Further, the switch 34 is in the nature of a dead-man switch in that if the operator removes himself from the position of holding the switch 34 in its open position, as described above, then the engine will cease operation since the switch 34 will ground the engine's electric circuit, as described.

In starting the engine 12, the operator must position himself on the side of the mower adjacent the switch 33, and he must depress the actuator 38 by putting his foot thereon in order to open the switch 33 and avoid grounding the electric circuit. In doing this, the operator is on the side of the mower opposite from the usual mower discharge chute 57, and thus the operator is in a safe position. Also, the operator will have his one foot on the actuator 38, and thus he will position his other foot a distance away from the deck 10, in order to get normal body balance and stability for himself, and thus his feet are not endangered by the rotation of the cutter blade 26. Once the engine 12 has started to run, the operator will then reach to the actuator 48 and hold it in its operative or depressed position, and he can then release his foot from the actuator 38 and he can move to a position for conventional grasping of the handle portion 27 and the actuator 48 and keep the latter in the depressed position so that the engine will continue to operate. In this arrangement, the invention requires that there be and provides for two operator stations, and the operator must therefore position himself in a certain but very safe and efficient position relative to the powered machine, in order to insure that the machine will operate. Since permitting the both switches 33 and 34 to be in their normal position, that is the closed position, the usual stop switch 22 could be dispensed with since the engine 12 will stop whenever the operator is not in physical contact with either one of the switches 33 and 34. However, the switch 22 is not a self-positioning switch and it may be set in either the open or closed position in contrast to the switches 33 and 34 which are normally-closed switches, and these switches reach their normally-closed positions by self-actuating means, and spring means are shown in the particular embodiment described herein but of course there may be other ways of causing the switches 33 and 34 to be positioned to a normal position achieved in the absence of physical contact by the operator, as described herein. Thus the switches 33 and 34 are connected to the primary circuit side of the magneto 21 to automatically stop the operation of the engine 12, as described, and of course the switches 33 and 34 are in electric series connection with the electric circuitry for the engine.

What is claimed is:

1. A gasoline powered machine comprising a gasoline engine, an electric circuit electrically connected to said engine for conducting electrically to said gasoline engine for operation of said gasoline engine, two electric switches electrically connected together in series with said electric circuit, both of said switches including spring means operative in both of said switches and yieldingly urging said switches to the normally closed position and said normally-closed switches being electrically connected with said machine in an electrically grounded connection, whereby said electric circuit is grounded through said switches to thereby interrupt the operative electric connection of said circuit with said engine and thereby require that at least one of said switches be retained in its electrically open position in order to avoid the grounding of said circuit when it is desired that said engine be operating, and both of said switches including actuator means operative on said spring means for overcoming the urging of said spring means to thereby open said switches and allow the operator to hold said actuators against the forces of said spring means to effect positioning said switches in the electrically open positions.

2. The machine as claimed in claim 1, wherein said machine has two operator's stations spaced apart on said machine, and said two switches being disposed on said machine at respective ones of said two stations.

3. The machine as claimed in claim 1, wherein said machine is a lawn mower having a cutter-supporting member and a handle connected to said member and extending therefrom, one of said switches being mounted on said handle, the other of said switches being mounted on said cutter-supporting member and having its said actuator operable by the operator's foot.

* * * * *